US005298876A

United States Patent [19]

Kulik et al.

[11] Patent Number: 5,298,876

[45] Date of Patent: Mar. 29, 1994

[54] BI-METALLIC SWITCH ELEMENT

[75] Inventors: Joseph S. Kulik, Allenstown, N.H.; Robert J. Vincent, No. Scituate, R.I.; Simone P. Bazin, Bedford, N.H.

[73] Assignee: GTE Products Corporation, Danvers, Mass.

[21] Appl. No.: 56,006

[22] Filed: Apr. 30, 1993

[51] Int. Cl.[5] ..... H01H 61/00; H01H 37/52

[52] U.S. Cl. ..... 337/27; 337/102; 337/379

[58] Field of Search ..... 337/14–32, 337/99–111, 372, 379

[56] References Cited

U.S. PATENT DOCUMENTS 3,312,802 4/1967 Ryckman, Jr. ..... 337/102

*Primary Examiner*—Harold Broome

*Attorney, Agent, or Firm*—William H. McNeill

[57] ABSTRACT

A bi-metallic switch element 10 has a contact wire 26 attached thereto by means of a plurality of crimps. A first crimp 28 applied at a first pressure fixes the contact wire to the element and a second crimp 30, formed at a lesser, more controlled pressure aligns the contact wire in a predetermined location.

2 Claims, 1 Drawing Sheet

BI-METALLIC SWITCH ELEMENT

TECHNICAL FIELD

This invention relates generally to bi-metallic switch elements and more particularly to such elements having better control over the location of a contact wire which is a part of the element. The element can form a part of a switch which can be employed in the starting circuitry of high intensity discharge lamps.

BACKGROUND ART

The basic elements of a bi-metal switch include at least a bi-metal member which usually is elongated and which can have a contact wire attached thereto. Generally, it is important that the contact wire be accurately positioned on the bi-metal. Two major forms of attachment have been employed in the past. A first simply involves welding the contact wire to the bi-metal and a second involves attaching the wire by means of a crimp. The latter method has been accomplished by stamping either a tunnel or a pair of tabs from the bi-metal, laying a wire in the opening thus provided, and crimping the tabs or tunnel to the wire. While these methods provided an adequate holding means for the wire they did not provide for accurate location, since very often the force applied to fix the wire disturbed whatever previous location had been determined.

DISCLOSURE OF THE INVENTION

It is, therefore, an object of the invention to obviate the disadvantages of the prior art.

It is another object of the invention to enhance bi-metal switch elements.

yet another object of the invention is the enhancement of the operation of bi-metal switch elements.

These objects are accomplished, in one aspect of the invention, by the provision of a bi-metallic switch element which comprises an elongated bi-metallic member having a longitudinal axis and comprised of a relatively high expansion material and a relatively low expansion material in operative, intimate contact with one another. Two spaced apart tunnels are formed in a first end of the member and project upwardly from the high expansion material. The tunnels are formed transverse to the longitudinal axis. An elongated, electrically conductive contact wire has one end thereof positioned in the tunnels. Crimps are formed in the tunnels with a first crimp being formed in a first of the tunnels fixing the wire to the bi-metallic element and a second crimp being formed in a second of the tunnels for positioning the wire in a predetermined location relative to the bi-metallic element.

The employment of the plural tunnels allows for the use of differential pressures for each of the crimps and provides for control over the location of the contact wire.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
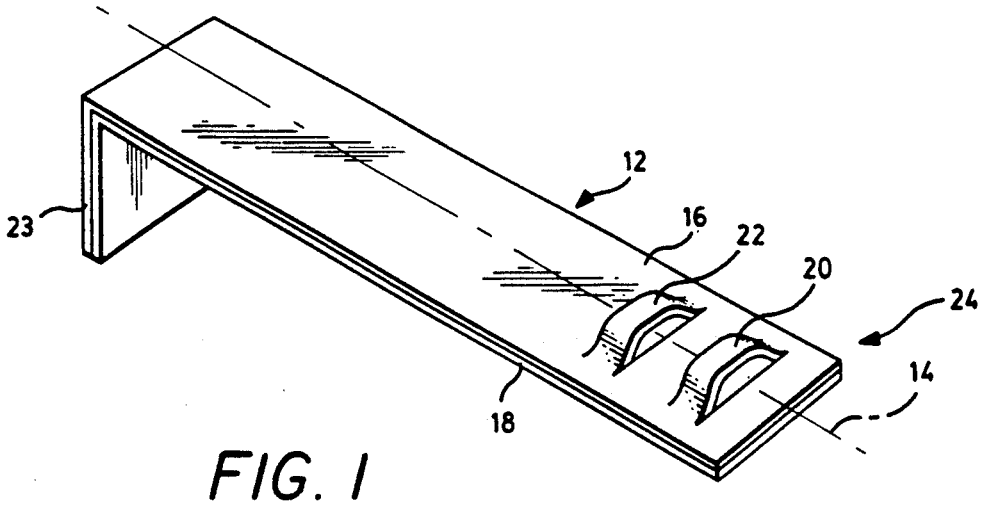
FIG. 1 is a perspective view of a bi-metallic element having a pair of contact wire receiving tunnels formed in one end thereof.
Figure 3:
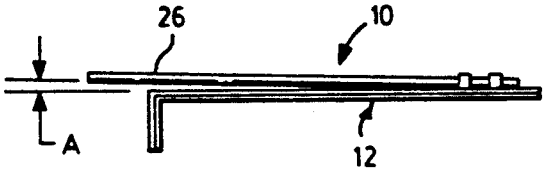
FIG. 3 is a side elevational view of a bi-metallic element illustrating a placement of the contact wire.
Figure 2:
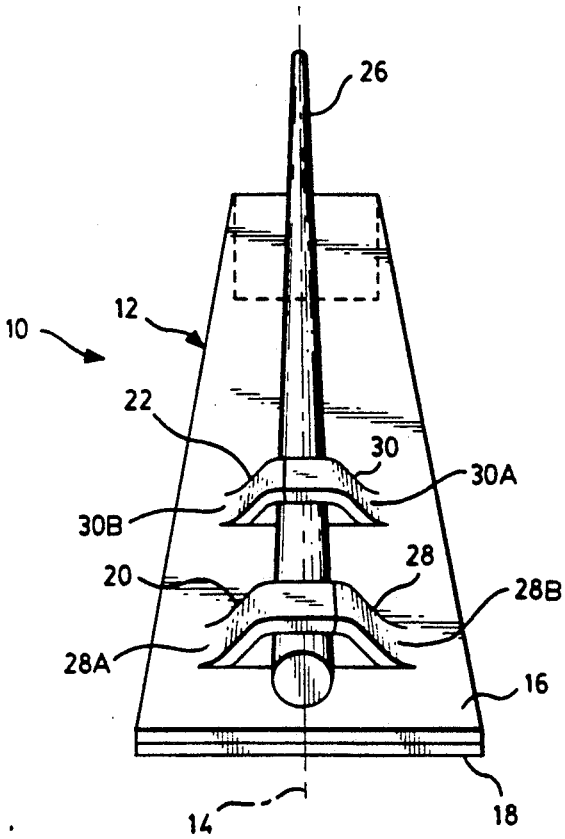
FIG. 2 is a perspective view of a bi-metallic element with a contact wire crimped in the tunnels.

Referring now to the drawings with greater particularity, there is shown in FIGS. 2 and 3 a bi-metallic switch element 10 which comprises an elongated bi-metallic member 12, shown by itself in FIG. 1, having a longitudinal axis 14 and comprised of a relatively high expansion material 16 and a relatively low expansion material 18 in operative, intimate contact with one another. A suitable material is ASTM B388 Type TM5. Two spaced apart tunnels 20 and 22, respectively, are formed in a first end 24 of member 12 and project upwardly from the high expansion material 16. An opposite end of the element 12 has a right angle bend formed therein to provide a wall 23. The tunnels are formed transversely to the longitudinal axis. An elongated, electrically conductive contact wire 26, which preferably is formed from a high tensile tungsten wire such as NS-55N which is available from OSRAM SLYVANIA, Townada, Pa. 18848, has one end thereof positioned in the tunnels. (As used herein, high tensile designates wire having a strength of 67–72 gm/mg/200 m). A first crimp 28 is formed in a first of the tunnels, e.g., 20, to fix the wire 26 to the bi-metallic element 12. The crimp 28 causes an asymmetric rupture of the tunnel, as is shown in FIG. 2, and provides what appears to be a pair of tabs **28*a* and 28*b*. The asymmetry is caused by the use of an offset clamping punch. A first, relatively high pressure is employed to form the crimp 28. A second crimp 30 is formed in the second tunnel 22 and is used to position the wire in a predetermined position relative to the bi-metallic element 12. The second crimp 30 also provides an asymmetric rupture of the tunnel to form tabs 30*a* and 30*b*. These latter tabs are asymmetric with respect to the tabs 28*a* and 28*b* and both sets of tabs are asymmetric with respect to the centerline 14**.

The second crimp 30 is preferably formed at a lower pressure than the first crimp to aid in positioning the location of the wire. This can be accomplished by making the second set of clamping tools slightly longer than the first set. In the embodiment of the invention shown and described below, the second set of tools can be 0.003" (0.0076 mm) longer than the first set.

The preferred location of the contact wire 26 is contiguous with the surface of the element 12 and aligned along centerline 14. As shown in FIG. 3 by the dimension "a", a small tolerance is acceptable. In a preferred form of the invention the tolerance should be no greater than 1 mm for a switch element having a length of 0.875" (2.223 mm) and a width of 0.125" (0.318 mm). The tunnels have a width of about 0.040" (0.102 mm) and can be separated by about 0.046"–0.050" (0.117–0.127 mm). The transverse length of the tunnels is about 0.0625" (0.158 mm).

While not limited thereto, the switch 10 described herein has greatly improved the operation of high intensity discharge lamps by providing an accurate cycle time over the life of the lamps.

While there have been shown and described what are at present considered to be the preferred embodiments of the invention, it will be apparent to those skilled in the art that various changes and modifications can be made herein without departing from the scope of the invention as defined by the appended claims.

What is claimed is:

1. A bimetallic switch element comprising: an elongated bimetallic member having a longitudinal axis and comprised of a relatively high expansion material and a relatively low expansion material in operative, intimate contact with one another; two spaced apart tunnels formed in a first end of said member and projecting upwardly from said high expansion material, said tunnels being transverse to said longitudinal axis; an elongated, electrically conductive contact wire having one end thereof positioned in said tunnels and another end of said contact wire projecting beyond a second end of said elongated bimetallic element; each of said tunnels being crimped to said wire, each of said tunnels thereby being separated into two tabs, said tabs being asymmetric with respect to said centerline, and the tabs of the first of said tunnels being asymmetric with respect to the tabs of the second of said tunnels.

2. A bi-metallic switch element comprising: an elongated bi-metallic member having a longitudinal axis and comprised of a relatively high expansion material and a relatively low expansion material in operative, intimate contact with one another; two spaced apart tunnels formed in a first end of said member and projecting upwardly from said high expansion material, said tunnels being transverse to said longitudinal axis; an elongated, electrically conductive contact wire having one end thereof positioned in said tunnels; and crimps formed in said tunnels, a first crimp formed in a first of said tunnels fixing said wire to said bi-metallic element and a second crimp formed in a second of said tunnels positioning said wire in a predetermined location relative to said bi-metallic element.

* * * * *